US005996457A

United States Patent [19]

Wingeron, Jr.

[11] Patent Number: 5,996,457

[45] Date of Patent: Dec. 7, 1999

[54] APPARATUS FOR DESTRUCTION OF TICKETS AND THE LIKE

[75] Inventor: John Wingeron, Jr., Perkasie, Pa.

[73] Assignee: Deltronic Labs Inc., Chalfont, Pa.

[21] Appl. No.: 08/893,002

[22] Filed: Jul. 15, 1997

[51] Int. Cl.[6] ..... B02C 18/14

[52] U.S. Cl. ..... 83/349; 83/672; 241/242

[58] Field of Search ..... 241/242; 83/37, 83/349, 672

[56] References Cited

U.S. PATENT DOCUMENTS

| | | | |
|---|---|---|---|
| 7,756 | 11/1850 | Macomber | 241/242 |
| 176,393 | 4/1876 | Witt et al. | 241/242 |
| 221,371 | 11/1879 | Stevens | 241/242 |
| 294,673 | 3/1884 | Rhodes | 241/242 |
| 3,037,410 | 6/1962 | Sarka | 83/37 |
| 3,094,027 | 6/1963 | Alexander et al. | 83/37 |
| 4,055,309 | 10/1977 | Fleming et al. | 83/349 |
| 4,426,898 | 1/1984 | Friberg | 83/37 |
| 4,484,505 | 11/1984 | Lewallyn | 83/672 |
| 4,657,192 | 4/1987 | Browning | 241/242 |
| 4,664,006 | 5/1987 | Mitchell | 241/242 |
| 4,669,344 | 6/1987 | Herrrig | 83/37 |
| 4,949,606 | 8/1990 | Pfeiffer | 83/672 |
| 5,001,953 | 3/1991 | Pfeiffer | 83/349 |
| 5,211,093 | 5/1993 | Horniak . | |
| 5,452,632 | 9/1995 | Durr et al. | 83/37 |
| 5,454,532 | 10/1995 | Matsuda | 241/242 |

*Primary Examiner*—Rinaldi I. Rada
*Assistant Examiner*—Gyounguyun Bae
*Attorney, Agent, or Firm*—William H. Eilberg

[57] ABSTRACT

A device for destroying used tickets includes a housing and a cutter which is removably mounted to the housing. The cutter includes an enclosure having a slot which allows tickets to enter. The cutter also has a rotating blade which cuts the tickets as they pass through the slot. Both the slot and the blade are inclined relative to the horizontal, the inclinations of the slot and the blade being mutually opposite. Thus, the ticket is subjected to an effective angle of shear which is equal to the sum of the angles of inclination of the blade and the slot. The blade is in geared engagement with the same motor that operates a plurality of rollers for advancing the tickets through the device. The cutter enclosure is detachably mounted to the housing, so that it can be quickly and easily removed for servicing. The cutter effectively destroys the incoming tickets, preventing them from ever being re-used.

8 Claims, 3 Drawing Sheets

APPARATUS FOR DESTRUCTION OF TICKETS AND THE LIKE

BACKGROUND OF THE INVENTION

This invention comprises a device for destroying used tickets or similar items.

Paper tickets are commonly used in movie theatres, arcades, hotels, airports, and other facilities. Tickets must often be redeemed at a specified price for a given number of tickets. Thus, it is necessary to count the tickets presented, and then to destroy them, so that they cannot be improperly re-used.

One common method of destroying used tickets is to tear them by hand. This method works with individual tickets, but is extremely tedious and impractical for destroying large numbers of long strips. Also, the residue of the torn tickets is bulky, and requires considerable storage space.

It has also been known to use hand-operated cutting devices. Such devices are also impractical for use with large numbers of tickets, and also suffer from the disadvantage that they leave a bulky residue.

Various automated devices have been proposed to destroy used tickets. One such mechanized device cuts a strip of tickets longitudinally in half. The latter device is shown in U.S. Pat. No. 5,211,093, the disclosure of which is hereby incorporated by reference herein. Using this device is much faster than cutting tickets by hand, but the device has the disadvantage that the strip is not rendered completely useless. Unscrupulous persons can attach the severed longitudinal halves of the strip to form a complete strip which could be used again.

Various paper cutters have been commercially available, and they vary greatly from one to another. Some cut longitudinally on large sheets of paper, while others cut transversely on large and heavy paper. All need sufficient power to operate, depending on the thickness of the paper being cut.

The cutting performance of smaller cutters depends on the size of the motor used in the cutter, and on the amount of shear used in making the cut. The amount of shear affects the load on the motor, which thus affects the size of motor required. Since tickets vary greatly in paper quality and coatings, a device for destroying used tickets should be capable of operating through a wide range of ticket types.

The present invention solves the problems described above, by providing a mechanized apparatus which renders strips of tickets completely useless, and which results in a relatively compact residue. The present invention also has the advantage that the cutter needs no separate drive mechanism, apart from the means for advancing the tickets through the device. Also, the device includes a modular cutter which can be quickly removed and replaced, without using any tools.

SUMMARY OF THE INVENTION

The apparatus of the present invention includes a housing which holds a motor, a cutter, and a set of rollers. The rollers receive and advance a strip of paper tickets along a horizontal path. Through appropriate gear and/or belt connections, the motor moves both the rollers and the cutter blade. The cutter comprises a unitary enclosure, within which the blade can rotate. The cutter is detachably affixed to the housing, and can be removed and re-installed with very minimal effort.

The cutter enclosure has a slot which receives the incoming strip of tickets. The slot is inclined relative to the horizontal path. The rotating cutter blade preferably includes two vanes, which are also inclined relative to the horizontal path, the inclinations of the slot and the vanes being mutually opposite. Thus, the effective shearing angle "felt" by the paper tickets is the sum of the angles of inclination of the slot and the vanes.

The cutter blade is rotated by a geared or belt drive connection with the same motor that moves the tickets through the housing. Thus, the apparatus does not require a separate drive for the cutter. The cutter is entirely modular; it locks into a slot formed in the housing, and can be easily removed for servicing, almost without touching any of the other components of the apparatus, and without the need for special tools.

The present invention therefore has the primary object of providing an apparatus for destroying strips of paper tickets.

The invention has the further object of providing an apparatus as described above, which apparatus renders the tickets completely useless, therefore preventing unscrupulous persons from reassembling and re-using the tickets.

The invention has the further object of destroying paper tickets in a manner which leaves a residue having relatively small bulk.

The invention has the further object of providing a device for destroying used tickets, in which the cutting mechanism is modular, and is easily removable from the main housing of the device.

The invention has the further object of providing a device for destroying used tickets in which the effective angle of shear is increased, thereby reducing the amount of force needed to cut the tickets.

The invention has the further object of providing an efficient method of destroying paper tickets.

The reader skilled in the art will recognize other objects and advantages of the present invention, from a reading of the following brief description of the drawings, the detailed description of the invention, and the appended claims.

DETAILED DESCRIPTION OF THE INVENTION

Before explaining the structural features of the apparatus of the present invention, it is helpful to review the theory underlying the cutting operation. In designing a device for destroying used tickets, one seeks to maximize the effectiveness of the cutting mechanism, for a given size of motor. As explained below, it turns out that the effectiveness of the motor depends critically on the shear angle "seen" by the ticket being cut. In particular, the force F required to cut a ticket, using a horizontal cut, is given by:

$$F=tLS$$

where t is the thickness of the ticket,

L is the length of the cut, and

S is the shear stress of the paper.

The value of S is about 6400 psi for hard paper and 6000 psi for soft paper.

Since the angle of shear a is given by $$\tan a=t/L,$$

it follows that $$F=(t^2/\tan a)(S).$$

The above equation shows that the force required to cut varies inversely with the tangent of the angle of shear. Thus, the greater the angle of shear, the smaller the force required to cut.

In one example, if the only shear is due to the thickness of the ticket itself, for a ticket which is 0.008 inches thick and 1.156 inches wide, of hard quality paper, the force required to cut would be over 59 pounds. The latter figure is much too high to be practical with a small motor. In order to perform the cutting efficiently, one needs a greater amount of shear. It can be shown that a shear angle of 30° is large enough to keep the size of the motor within practical limits. The present invention increases the effective angle of shear even beyond 30°, thereby further reducing the demand on the motor.

Figure 1:
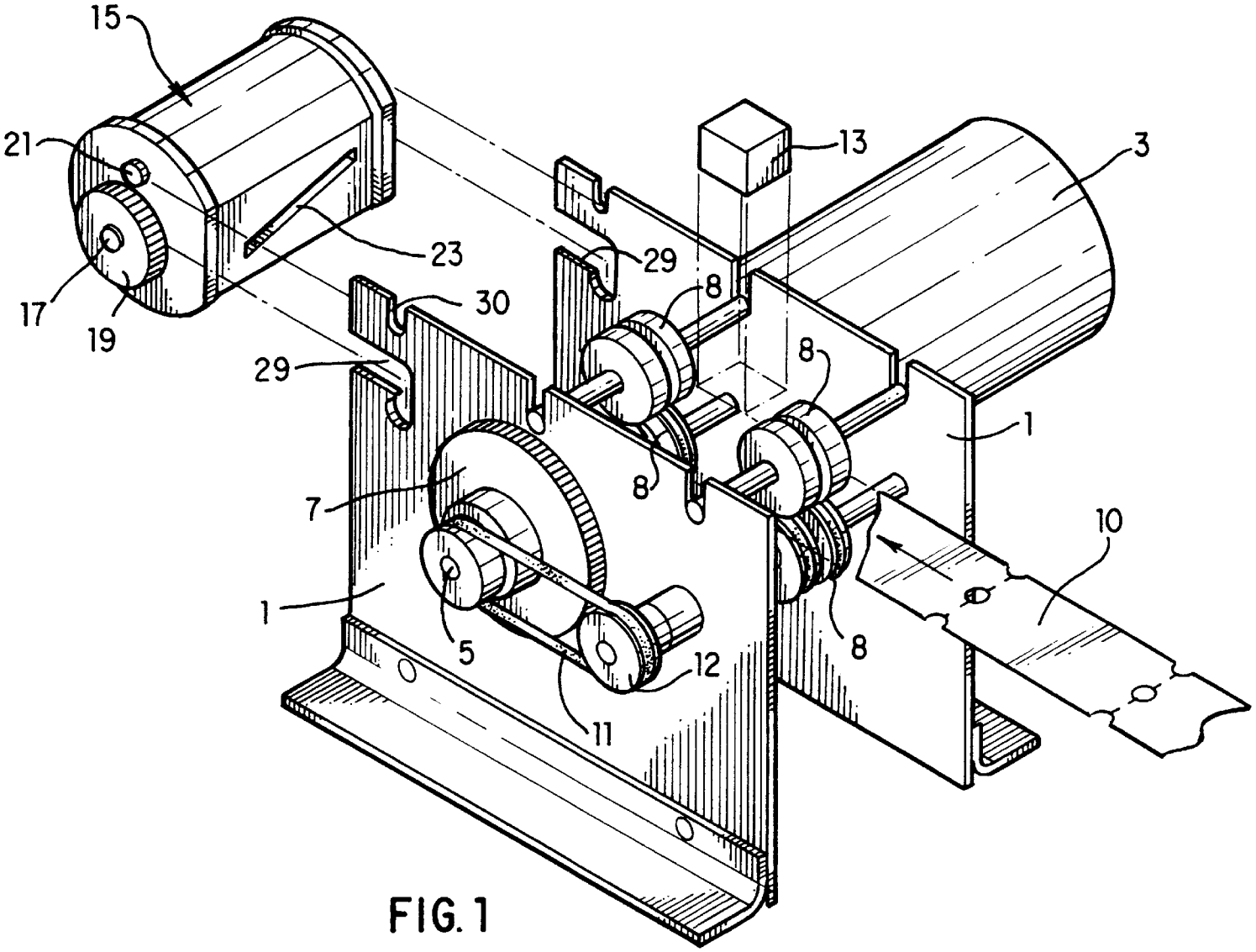
FIG. 1 provides a perspective view of the apparatus of the present invention, the figure showing the cutter before it has been affixed to the housing.

FIG. 1 provides a partially exploded perspective view of the apparatus of the present invention. The apparatus is formed in a housing defined by side walls 1. Motor 3 is mounted to the housing, and its drive shaft 5 turns gear and pulley assembly 7. Rollers 8 sit within the housing, and advance a strip 10 of tickets through the apparatus. One of the lower rollers is connected to the drive shaft and is therefore directly driven by the motor, while the other lower roller is indirectly driven by belt 11 and pulley 12. The upper rollers are idler rollers, and are driven by contact with the lower rollers.

Photoelectric sensor 13 is positioned over the strip of tickets, to provide means for counting the tickets as they move through the device, and before they are destroyed. The sensor may be connected to an external computer (not shown), or other equivalent device, for recording the number of tickets detected by the sensor.

The apparatus also includes cutter 15, shown detached from the housing. The cutter, which will be described in more detail below, comprises an enclosure which houses a rotating blade (not visible in FIG. 1). The rotating blade is driven by shaft 17 which is connected to gear 19. When the cutter is installed in the housing, gear 19 engages gear assembly 7, so that the cutter blade is driven by the same motor that drives the rollers. Anti-rotation pin 21 rests in recess 30 formed in the housing, and prevents the cutter enclosure from rotating when the cutter is operating. There are two pins 21; only one is visible in the view of FIG. 1. The anti-rotation pins protrude from the end plates of the cutter. The cutter has a slot 23 which is inclined relative to the horizontal. The slot allows tickets to enter the cutter enclosure.

Figure 2:
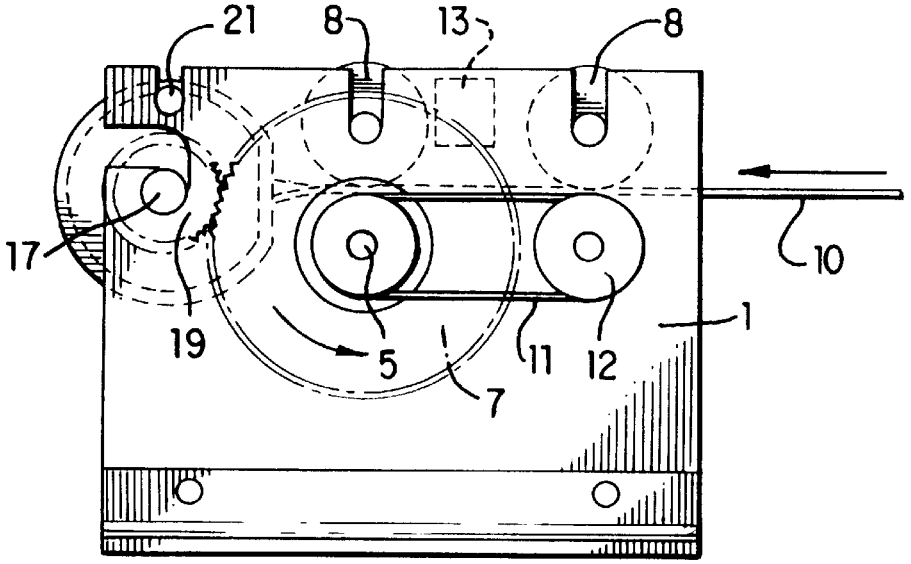
FIG. 2 provides a side view of the apparatus of the present invention, showing the arrangement of gears and rollers.
Figure 3:
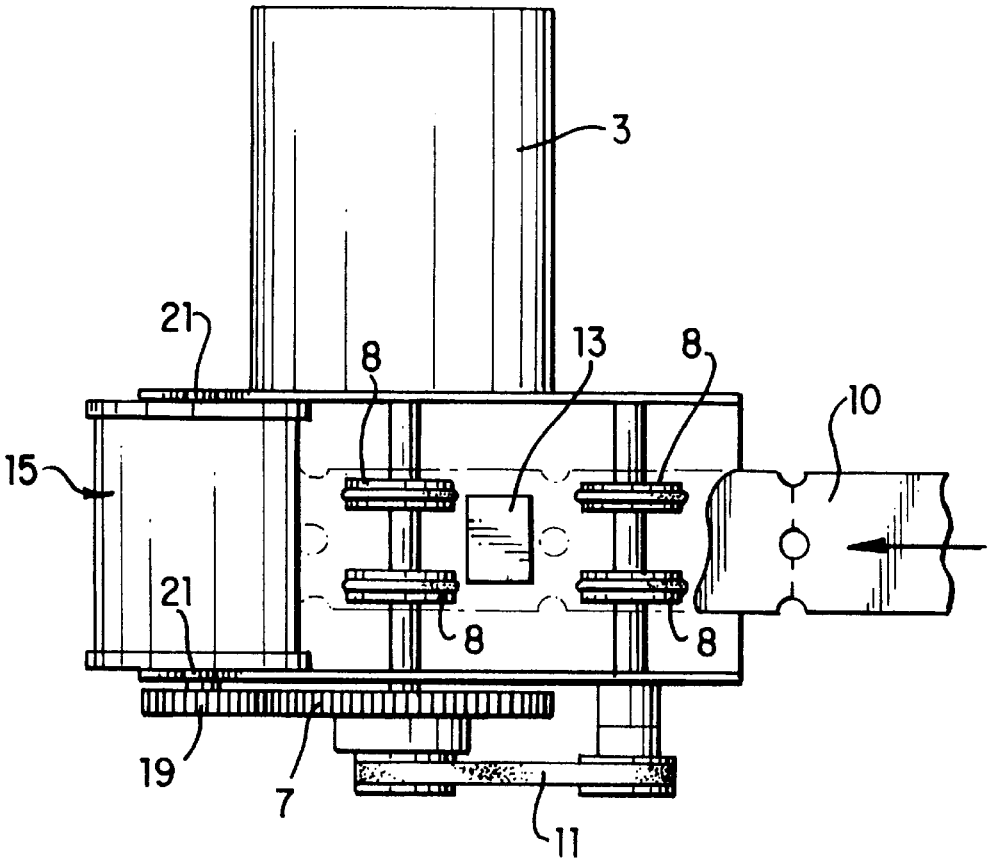
FIG. 3 provides a top view of the apparatus of the present invention, showing a strip of tickets being fed into the device.
Figure 4:
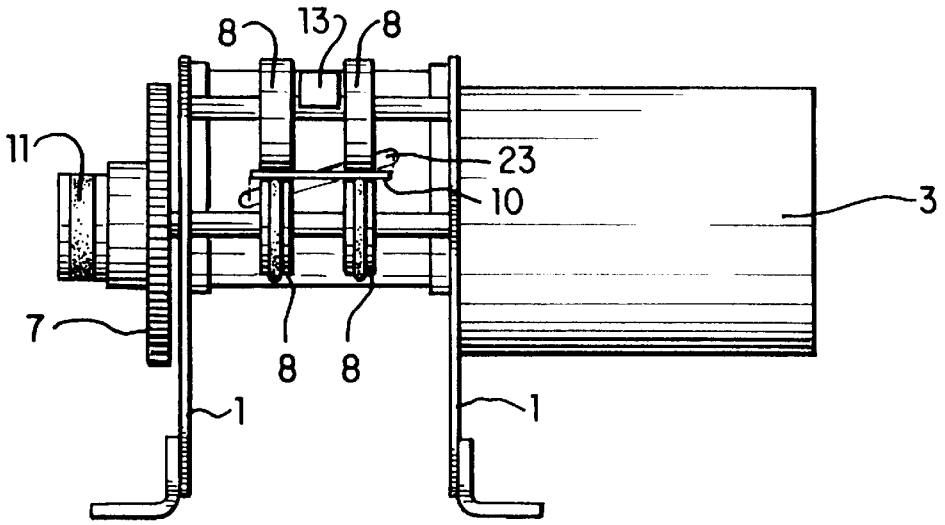
FIG. 4 provides an end view of the apparatus of the present invention.

FIG. 2 provides a side elevational view, showing the interrelationships among the various gears and rollers. FIG. 3 provides a top view, showing the strip of tickets being advanced through the device by the rollers. The end view of FIG. 4 shows the strip 10 of tickets as it is advancing towards slot 23. The dimensions of the slot are chosen so that the slot is sufficiently wide to allow the strip of tickets to enter the slot easily, even though the slot is inclined relative to the initial position of the strip. The tickets therefore enter the slot, as illustrated in FIG. 5, and become twisted relative to their original orientation.

Figure 5:
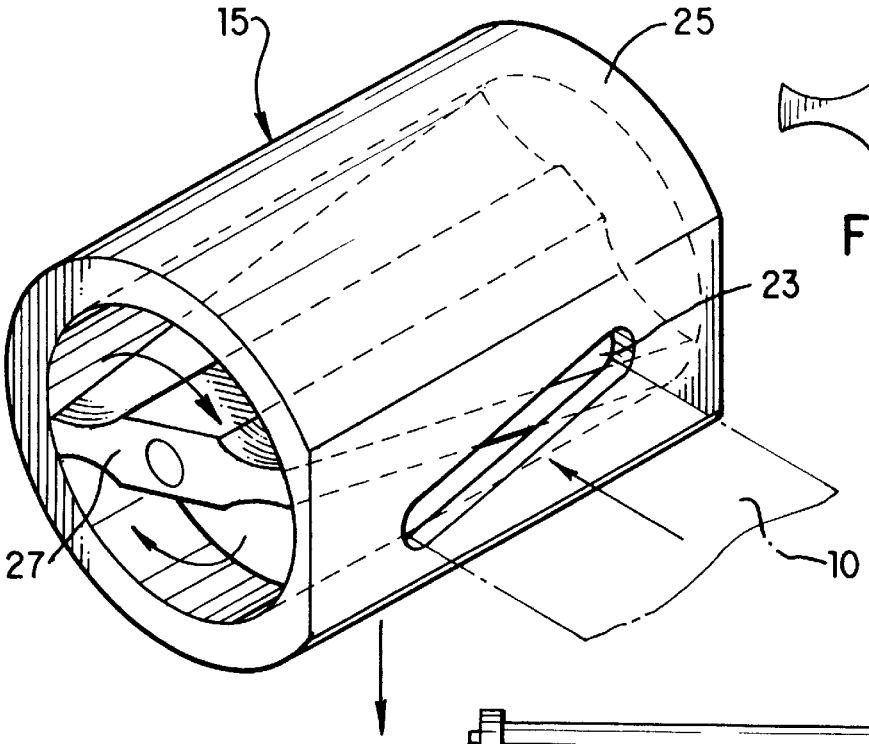
FIG. 5 provides a perspective view of the cutter assembly used in the apparatus of the present invention, and showing the shape of the cutter blades partly in dotted outline.
Figure 5A:
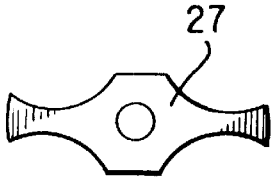
FIG. 5A provides an elevational view showing the preferred shape of the cutter blade, in the present invention.
Figure 6:
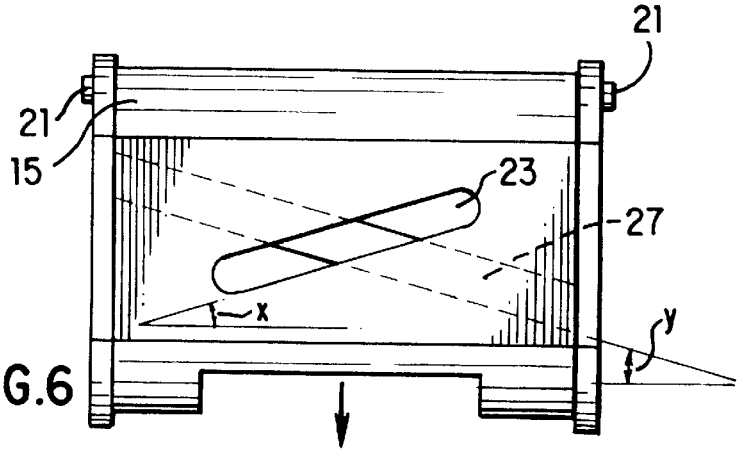
FIG. 6 provides an elevational view of the cutter assembly, illustrating the effective increase in shearing angle achieved in the present invention.

FIG. 5 provides a perspective view of the cutter 15, without its end plates. The cutter includes enclosure 25 which houses rotating blade 27. FIG. 5A illustrates the preferred cross-sectional shape of the blade. The blade is twisted, as shown in FIG. 5, and as also shown by FIG. 6, so that each vane of the blade is inclined at an angle designated as y in FIG. 6. The slot itself is inclined at angle x. The inclinations of the blade and the slot are oriented in mutually opposite directions, so that the effective shearing angle "seen" by the tickets is the sum of angles x and y. In one embodiment, angle x may be 15° and angle y may be 25°, for a total effective shearing angle of 40°. The invention is not limited, however, by the specific choices of angles. As shown by the explanation given above, an effective shearing angle of 40° is more than adequate for efficient cutting.

As illustrated by FIG. 5A, and as is also shown in FIG. 5, each vane of the blade is flared at its radially outer end, so that the cutting edges of the blade are especially sharp. Rapid rotation of the cutter blade causes the incoming ticket to be cut into tiny pieces as it is advanced into the cutter enclosure. The residue of the cutting does not occupy substantial bulk, and it is virtually impossible to reconstruct the original ticket.

The preferred material for the rotating cutter blade is steel C.R.S. 1018, case hardened to Rockwell 58–60 "C" scale, 0.020 inches deep. The enclosure of the cutter is preferably made of the same material. While the latter material is preferred, the invention is not limited to use with a particular material.

Although the drawings illustrate the use of the device on a strip of tickets, the device of the present invention will also operate on single tickets. The invention is not necessarily limited to use with tickets, but can be used to cut other materials.

An important feature of the present invention is the modular quality of the cutter. The cutter is self-contained within its enclosure, and can be easily removed from the cutter housing, and then replaced, simply by using the slots 29 provided in side walls 1. These slots allow the cutter to be locked in place on the housing. The cutter can therefore be removed for servicing the blade, without substantially disturbing the remainder of the apparatus. Moreover, the cutter can be inserted and removed without using a tool; not even a screwdriver is required.

The cutter is further locked in place by the anti-rotation pin 21, which engages the enclosure as illustrated in FIG. 2. The anti-rotation pin prevents the enclosure from rotating when the blade is rotated by engagement of the gears.

Another important feature of the invention is that the drive mechanism which moves the tickets through the machine is the same mechanism that powers the cutting blade.

Still another important advantage of the invention is that the cutting operation can be performed with a relatively small motor, while still cutting the tickets efficiently. The high effective shearing angle, combined with the relatively small motor, also reduces the level of noise generated by the cutter, as compared with the devices of the prior art.

While the invention has been described with respect to the preferred embodiments, various other modifications are possible. The invention should not be limited to the embodiments given by example. The modifications which will be apparent to the reader skilled in the art should be considered within the spirit and scope of the following claims.

What is claimed is:

1. Apparatus for destroying used tickets, comprising:

a) a housing, b) means mounted in said housing for receiving and advancing a strip of tickets along a horizontal path, and c) a cutter mounted in said housing, wherein the cutter comprises an enclosure having a rotating blade within the enclosure, the enclosure including a slot having an internal edge and an inclination relative to said horizontal path, the blade having a cutting edge, wherein the blade is positioned sufficiently close to the internal edge of the slot such that the blade and the internal edge together comprise means for cutting tickets passing through the slot, wherein the blade also has an inclination relative to said horizontal path, wherein the inclinations of the slot and the blade are oriented in mutually opposite directions, wherein the cutter is removably mounted within a pair of open slots, the slots being formed in said housing, the slots comprising means for permitting the cutter to be removed from the housing without use of a tool.

2. Apparatus for destroying used tickets, comprising:

a) a housing, b) means mounted in said housing for receiving and advancing a strip of tickets along a horizontal path, and c) a cutter mounted in said housing, wherein the cutter comprises an enclosure having a rotating blade within the enclosure, the enclosure including a slot having an internal edge and an inclination relative to said horizontal path, the blade having a cutting edge, wherein the blade is positioned sufficiently close to the internal edge of the slot such that the blade and the internal edge together comprise means for cutting tickets passing through the slot, wherein the blade also has an inclination relative to said horizontal path, wherein the inclinations of the slot and the blade are oriented in mutually opposite directions, further comprising a non-threaded anti-rotation pin mounted within a recess in said housing, the anti-rotation pin being engaged with the cutter, the anti-rotation pin comprising means for preventing rotation of said cutter enclosure while the cutter is operating.

3. Apparatus for destroying used tickets, comprising:

a) a housing, b) means mounted in said housing for receiving and advancing a strip of tickets along a horizontal path, and c) a cutter mounted in said housing, wherein the cutter comprises an enclosure having a rotating blade within the enclosure, the enclosure including a slot having an internal edge and an inclination relative to said horizontal path, the blade having a cutting edge, wherein the blade is positioned sufficiently close to the internal edge of the slot such that the blade and the internal edge together comprise means for cutting tickets passing through the slot, wherein the blade also has an inclination relative to said horizontal path, wherein the inclinations of the slot and the blade are oriented in mutually opposite directions, wherein the slot is inclined at an angle of about 15°, and wherein the cutter blade is inclined at an angle of about 25°, wherein tickets entering the cutter experience an effective angle of shear of about 40°.

4. In an apparatus for destroying used tickets, the apparatus including a housing and means for advancing tickets through said housing, the improvement comprising a cutter which is removably attached to said housing, the cutter having an enclosure with a slot formed in the enclosure, the slot being of sufficient size to allow tickets to enter the slot, the slot having an internal edge, the cutter having a rotating blade within the enclosure, the blade having a cutting edge, wherein the blade is positioned sufficiently close to the internal edge of the slot such that the blade and the internal edge together comprise means for cutting tickets passing through the slot, wherein the housing defines a horizontal path for tickets, and wherein the slot is inclined at an angle relative to said horizontal path.

5. The improvement of claim 4, wherein the blade is inclined at an angle relative to said horizontal path, and wherein the blade and the slot have inclinations which are mutually opposite.

6. The improvement of claim 5, wherein the blade includes two vanes, wherein each vane has a radially outer end, and wherein each vane has a thickness which increases towards said radially outer end.

7. Apparatus for destroying used tickets, comprising:

a) a housing, b) a motor mounted to said housing, the motor being connected to a plurality of rollers which comprise means for receiving and advancing a strip of tickets along a horizontal path, and c) a cutter removably mounted to said housing, wherein the cutter comprises an enclosure having a rotating blade within the enclosure, the enclosure having a slot having an internal edge and an inclination relative to said horizontal path, the blade having a cutting edge, wherein the blade is positioned sufficiently close to the internal edge of the slot such that the blade and the internal edge together comprise means for cutting tickets passing through the slot, wherein the blade also has an inclination relative to said horizontal path, wherein the inclinations of the slot and the blade are oriented in mutually opposite directions, and wherein the cutter is in geared connection with the motor, wherein movement of tickets and movement of the cutter blade are caused by the same motor, wherein the cutter is removably mounted within a pair of slots, the slots being formed in said housing, the slots comprising means for permitting the cutter to be removed from the housing without use of a tool, the apparatus further comprising a non-threaded anti-rotation pin mounted within a recess in said housing, the anti-rotation pin being engaged with the cutter, the anti-rotation pin comprising means for preventing rotation of said cutter enclosure while the cutter is operating.

8. The apparatus of claim 7, further comprising photoelectric sensor means for detecting passage of tickets through the apparatus.

* * * * *